United States Patent [19]

Strickland

[11] 3,977,103

[45] Aug. 31, 1976

[54] CLAMP BAR FOR DRAPERY TABLES

[76] Inventor: Robert V. Strickland, 9021 Wedd, Overland Park, Kans. 66212

[22] Filed: July 9, 1975

[21] Appl. No.: 594,502

[52] U.S. Cl. ..... 38/108; 24/248 FS

[51] Int. Cl.[2] ..... D06F 81/00

[58] Field of Search..... 112/3 R, 3 A; 223/28, 223/51, 52, 61, 69, 70; 26/51; 38/102–102.91, 108; 33/1 R, 2 H; 214/1 R, 1 L, 1 F, 1.1; 254/1, 51, 68, 69, 105, 106; 160/371, 378, 382; 68/6; 34/151

[56] References Cited

UNITED STATES PATENTS

| | | | |
|---|---|---|---|
| 712,510 | 11/1902 | Dimick et al. | 38/102.1 |
| 2,759,273 | 8/1956 | Boyes | 38/102.1 X |
| 2,825,997 | 3/1958 | Piper et al. | 38/102.1 |
| 2,990,984 | 7/1961 | Fiduccia | 223/69 |

*Primary Examiner*—G. V. Larkin

*Attorney, Agent, or Firm*—John A. Hamilton

[57] ABSTRACT

A clamp bar for drapery tables consisting of a length of extruded metal which may be cut to any desired length, and along which a series of manual handle-operated clamps may be secured at any desired intervals for securing an edge of a sheet of drapery fabric thereto, the clamps being applicable separately, a lever member extending substantially the full length of the bar and being pivotal relative thereto about a longitudinal axis to release all of the clamps simultaneously, and a power mechanism operable from a central station to pivot the lever.

9 Claims, 4 Drawing Figures

CLAMP BAR FOR DRAPERY TABLES

Figure 1:
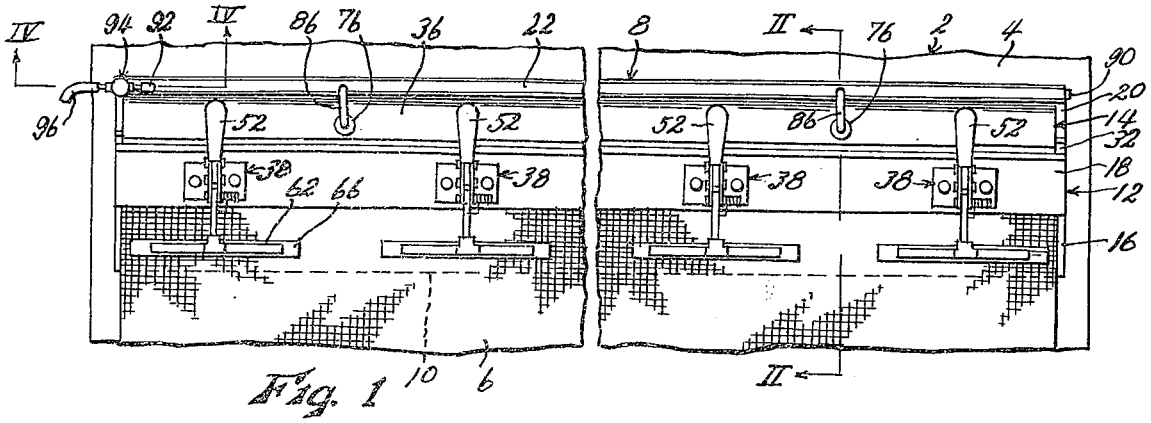

This invention relates to new and useful improvements in accessories for drapery tables, and has particular reference to a clamp bar having a series of clamp devices for securing an edge of a sheet of drapery fabric to said bar, the bar then being utilized to draw said fabric smoothly over the surface of a table.

Drapery tables of this general type are in extremely wide usage in the manufacture of draperies, the general object thereof being that when one previously cut or hemmed edge of a sheet of drapery fabric is clamped to the clamp bar, and the clamp bar moved across a table, all positions thereof being parallel, the fabric is drawn smoothly and evenly over the table surface, and the edge thereof opposite its clamped edge may then be marked, cut, hemmed or the like, with reference to an edge of the table parallel to the clamp bar, or to a reference or "zero" line imprinted on the table surface, with full assurance that the edge so treated is accurately parallel to the clamped edge.

The clamps which secure the fabric to the clamp bar are distributed along the length of the clamp bar, and must be closely spaced to hold the fabric edge reliably straight. The clamps are usually spaced no more than a foot apart, and the clamp bar is often thirty feet long or even longer, so that each clamp bar often carries thirty or more clamps. Since it is virtually impossible to hold a thirty foot fabric edge straight by any manual means, the clamps must be applied individually in a series, a short length of the fabric edge being drawn manually to a reference shoulder of the clamp bar, and held in place while one of the clamps is engaged, and so on along the full length of the clamp bar. However, after whatever operation being performed on the fabric while it is on the table has been completed, time could be saved if all of the clamps could be released simultaneously to free the fabric from the clamp bar. Several types of mechanical clamps are readily available on the commercial market, which are applied and released for example by opposite operation of a handle, but none to my knowledge which can be released simultaneously from a single central station.

The primary object of the present invention, accordingly, is the provision of a clamp bar which permits the use thereon of ordinary, commercially available handle-operated clamps, but which includes power-operated release means operable to release all of the clamps simultaneously, from a single control station, whenever desired. Generally, this object is accomplished by the provision of a release lever pivoted to the clamp bar and extending substantially the full length thereof, and operable when pivoted in one direction to engage the operating handles of all of the clamps and move said handles to a release position.

Another object is the provision of a clamp bar of the character described which may readily be formed in any desired length from a basic extruded section, with any desired spacing of the clamps. The release lever may also constitute an extruded section, and may be cut to any desired length.

A further object is the provision of a clamp bar of the character described which is formed basically of metal for strength, preferably of aluminum, but which is provided on all parts thereof engaging either the drapery table or the drapery fabric with a replaceable plastic coating, whereby to avoid the soiling or dark marking of the table or fabric which is commonly encountered when the clamp bar is formed of metal.

Other objects are simplicity and economy of construction, efficiency and dependability of operation, and adaptability for use in handling pliable sheet materials other than drapery fabric.

Figure 3:
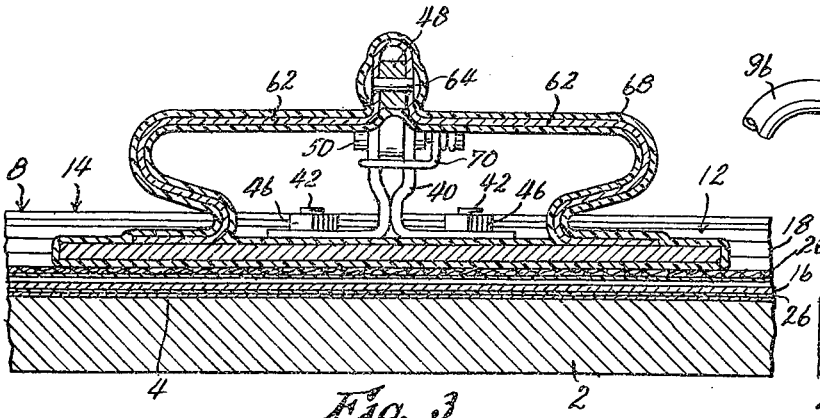
Figure 4:
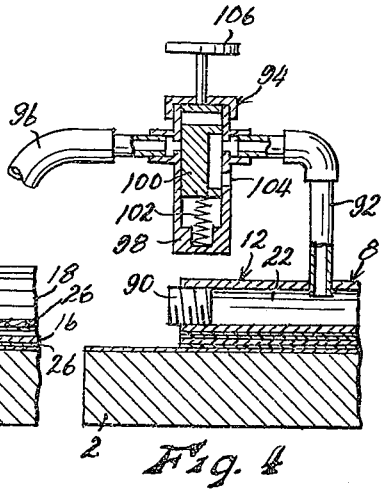
Figure 2:
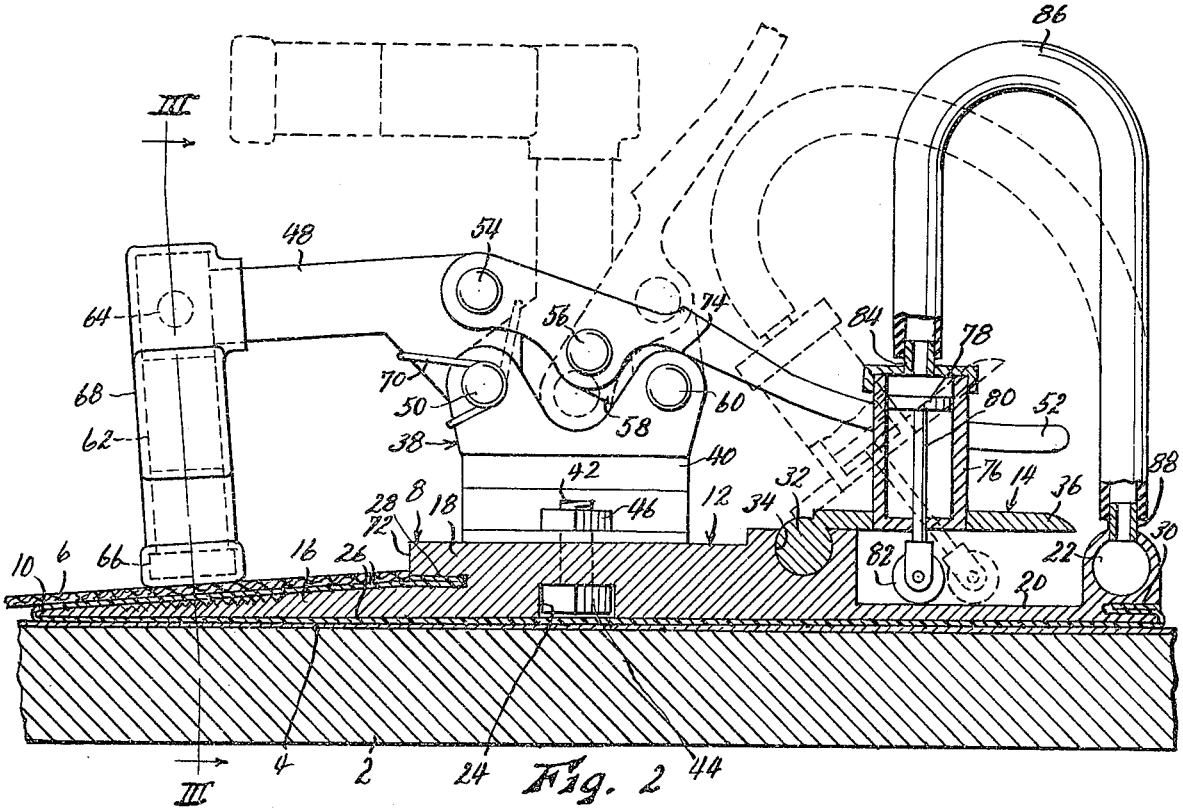

With these objects in view, as well as other objects which will appear in the course of the specification, reference will be had to the accompanying drawing, wherein:

FIG. 1 is a fragmentary top plan view, partially broken away and foreshortened, of a drapery table showing a clamp bar embodying the present invention applied thereto, and with a sheet of drapery fabric secured by the clamps of said clamp bar, FIG. 2 is an enlarged, fragmentary sectional view taken on line II—II of FIG. 1, FIG. 3 is a fragmentary sectional view taken on line III—III of FIG. 2, and FIG. 4 is an enlarged, fragmentary sectional view taken on line IV—IV of FIG. 1.

Like reference numerals apply to similar parts throughout the several views, and the numeral 2 applies to the top slab of a drapery table, which is horizontal and planar, usually being about 10 feet from front to rear, and 30 feet wide or even more. It is often covered with a fabric sheet 4 or other smooth material, cemented or otherwise bonded thereto, to protect drapery fabric, shown at 6, from damage as it rests on the table and moves thereover.

The clamp bar forming the subject matter of the present invention is indicated generally at 8, said clamp bar being elongated and as shown extending substantially the full width of table 2. It will be understood that said clamp bar is disposed parallel to the forward edge (not shown) of the table, and that the lower edge 10 thereof, as viewed in FIG. 1, is its forward edge. It will be understood that the clamp bar moves over the table surface transversely of itself, remaining parallel at all times to the forward edge of the table, or to a reference line imprinted on the table surface. To insure this parallel movement, each end of the clamp bar may be attached to the table by means permitting only the desired movement, for example by rollers carried by the clamp bar and moving in tracks or guides secured to the table. However, said attaching means is not pertinent to the present invention, and is not shown.

Clamp bar 8 includes two extruded sections of aluminum or other metal for maximum strength, and of uniform cross-sectional contours throughout their lengths, namely a body portion 12 and a release lever 14. Body portion 12 has a vertically thin forward portion 16, a thickened central portion 18, a thin rearward section 20, and an upward projection at its extreme rearward edge which is hollow to form an air passage 22. The lower surface of the body member is planar except for a rectangular groove 24 formed longitudinally in central portion 18 thereof. A sheet 26 of pliable plastic film underlies the body member, the forward edge portion of said sheet being turned upwardly around forward edge 10 of the body member to overlie forward portion 16 of the body member, and is tucked tightly into a groove 28 formed in the body member at the juncture of its forward and central sections. The rearward edge portion of sheet 26 is turned upwardly around the rearward edge of the body member, and is tucked tightly into a goove 30 formed in the rearward surface of said body member. Sheet 26 protects body portion 12 against contact either with table 2 or its cover sheet 4, or with drapery fabric 6, which as will appear is clamped against the top of body section 16, to prevent said body member from making discoloring "metal marks" on the table cover or drapery fabric.

Release lever 14 extends substantially the full length of the body portion, constituting a cylindrical forward edge formation 32 engaged pivotally in an upwardly opening cylindrical groove 34 formed in the top surface of thickened central portion 18 of the body member, adjacent the rearward edge of portion 18, and a generally planar flap 36 normally extending horizontally rearwardly, being supported by body portion 18 above rearward body section 20. Said flap may, however, be pivoted upwardly and forwardly as indicated in dotted lines in FIG. 2.

Mounted on central body portion 18, at regularly spaced intervals along the length of the clamp bar, are a series of fabric clamps 38. While several different types of clamps are in common usage, that actually shown includes an upstanding standard 40 (see FIGS. 2 and 3) secured to central body section 18 by a pair of bolts 42. After the desired spacing of the clamps is determined, a pair of bolt holes are drilled in body section for receiving the bolts of each clamp. Said bolt holes intersect body groove 24, and said groove encloses the heads 44 of said bolts, as shown in FIG. 2. The groove is sized to engage the bolt heads across the wrench flats of said heads, whereby to prevent rotation of the bolts as their nuts 46 are tightened. The bolts must of course be inserted before plastic sheet 26 is applied over the clamp bar. Also as best shown in FIG. 2, each clamp 38 also includes a forwardly projecting arm 48 pivoted at its rearward end to standard 40, as at 50. A handle 52 is pivoted at its forward end, as at 54 to arm 48 above pivot 50. Rearwardly of pivot 54, handle 52 is pivoted, as at 56, to one end of a short link 58, the other end of said link is pivoted, as at 60, to standard 40 in rearwardly spaced relation from pivot 50. The axes of all of pivots 50, 54, 56 and 60 are parallel, and handle 52 extends rearwardly in spaced relation above flap 36 of the release lever. Vertically yieldable spring arms 62 are fixed to the forward end of arm 48 by rivet 64, and support at their lower ends a rigid foot bar 66 which extends parallel to clamp bar 8, and is disposed above forward section 16 of the clamp bar. As will appear, foot bar 66 presses downwardly on the edge portion of the drapery material 6 supported on body member forward section 16. To prevent it from marking the material, and also to inhibit corrosion of spring arms 62, both the spring arms and the foot bar may be provided, as by dipping or otherwise, with a coating 68 of plastic or the like. Arm 48 is biased pivotally upwardly and rearwardly by a clock spring 70 mounted on pivot 50, bearing at one end against said arm and at its opposite end against standard 40.

It will be seen that when the portion of drapery fabric 6 to be engaged by a single clamp is laid over forward section 16 of the clamp bar, pulling the fabric edge against a vertical shoulder 72 of the clamp bar formed at the juncture of bar sections 16 and 18 to insure that the fabric edge is being mounted in a straight line, and handle 52 is pivoted downwardly and rearwardly from its dotted line position of FIG. 2 toward its solid line position, foot bar 66 is pivoted downwardly and forwardly to engage fabric 6 to secure it to the clamp bar. After it engages the fabric, further downward movement of handle 52 causes compression of spring arms 62, producing a still tighter clamping action on fabric 6. Eventually, handle pivot 56 passes downwardly through a plane established by the axes of pivots 54 and 60, and immediately thereafter, handle 52 engages standard 40 at 74, whereby to arrest further handle movement. This "toggle action" locks the clamp in its engaged position, as shown in solid lines in FIG. 2. Each clamp can be released manually simply by lifting the rearward end of handle 52 slightly, just enough to move the axis of pivot 56 slightly above the plane of pivots 54 and 60, whereupon spring 70 moves the clamp parts to the "released" position shown in dotted lines. The specific structure of the clamp as shown is intended as exemplary only. Several types of manually operable clamps are in common usage, but most of them have the common feature of being operable by the manual movement of an operating handle.

Individual engagement of clamps 38 is desirable, or even necessary, in securing the drapery fabric to the clamp bar, since it is virtually impossible to arrange a cloth edge which may be thirty feet long or longer by manual means in accurate position for simultaneous engagement of all of the clamps. However, after whatever operation being performed on the fabric while it is on the table has been completed, individual release of each of the clamps for removal of the fabric from the table, is unnecessary and represents a tedious, time-consuming chore. Release lever 14 provides a means for releasing all of the clamps simultaneously, by means of a single operation at a central station.

Mounted in flap 36 of the release lever, at intervals along the length thereof, are a series of pneumatic cylinders 76. Each cylinder extends upwardly from said flap, and carries a piston 78 operably therein. A piston rod 80 fixed to said piston extends downwardly below flap 36, and carries a wheel 82 at its lower end. The axis of said wheel is parallel to the longitudinal extent of the clamp bar, and said wheel has rolling engagement with rearward section 20 of the clamp bar. A nipple 84 threaded into the upper end of the cylinder has one end of a flexible rubber hose 86 interconnected thereto, and the opposite end of said hose is interconnected to a nipple 88 threaded into air passage 22 of the clamp bar. The ends of air passage 22 are sealed by plugs 90 threaded therein, and an air supply pipe 92 is threaded into said air passage at any convenient point thereof, adjacent one end thereof as shown. Disposed in said air pipe is a control valve 94 best shown in FIG. 4, and which is supplied with air under pressure from any suitable source, not shown, through a flexible hose 96, in order not to interfere with free movement of the clamp bar on table 2. As shown in FIG. 4, valve 94 includes a body member 98 in which a valve spindle 100 is freely slidable. Said spindle has a normal position, to which it is biased by a spring 102, wherein hose 96 is sealed off and air passage 22 of the clamp bar is vented to the atmosphere through a vent port 104, and an operating position to which it may be manually moved against spring 102 by depression of a pushbutton 106, in which port 104 is sealed off and air from hose 96 is supplied to air passage 22.

Thus, in operation, whenever pushbutton 106 is depressed, air is supplied to air passage 22 and thence through hoses 86 to pneumatic cylinders 76, which causes piston rods 80 to be extended to pivot flap 36 of the release lever upwardly. Wheels 82 greatly reduce any friction on section 20 of the clamp bar. As flap 36 pivots upwardly, it engages handles 52 of all of clamps 38, and pivots said handles upwardly sufficiently to "break" the toggle locking action of said clamps, whereupon opening of the clamps is completed by springs 70. When pushbutton 106 is released, all of the cylinders 76 are vented through port 104, and the release lever returns to its normal position, as shown in solid lines in FIG. 2, by gravity.

Generally, except in narrow tables using only short clamp bars, a plurality of air cylinders 76 are required for the release lever since if said lever were equipped with only a single operating cylinder, it might yield torsionally and fail to release some of the clamps, due to its extreme length as compared to its relatively small cross-sectional contour. FIG. 2 shows the release lever in an actual full size, and it may be thirty feet long or longer. Hence, as many cylinders may be used as may be found necessary, although one cylinder for every several clamps 38 is generally satisfactory. Care of course should be exercised to so place the cylinders and their hoses 86 that they do not interfere with movement of the clamp handles 52.

Thus it will be apparent that a clamp bar having numerous advantages has been produced. Its principal parts, body portion 12 and release lever 14, may be conveniently and economically produced in indeterminate lengths by extrusion, and thereafter easily cut to any desired length, as determined by the width of a drapery table on which the clamp bar is to be used. Thereafter, the only machining operations required are the drilling of holes for clamp mounting bolts 42 and hose nipples 88, and the drilling of holes in release lever flap 36 for receiving cylinders 76. The bolt holes may be drilled as determined by the clamp spacing desired, which in turn is determined by the particular type of clamps to be used. The holes for hose nipples 88, and for cylinders 76, may then be drilled at points intermediate certain successive pairs of clamps. Many types of commercially available manually operable clamps may be utilized, so long as each is operable by a handle 52 in the general manner shown. Release lever 14 and its operating means provide for instant and simultaneous release of all of the clamps from a single central station, thus eliminating the tedious and time-consuming operation of releasing each one in a separate manual operation. Cover sheet 26 prevents soiling of the table and drapery fabric by the clamp bar, and may itself be readily replaced when it becomes worn or soiled. Both the grooves 28 and 30 for mounting the cover sheet 26, and the mating elements 32 and 34 providing for the pivotal mounting of the release lever 14, are formed in the extrusion process.

While I have shown and described a specific embodiment of my invention, it will be readily apparent that many minor changes of structure and operation could be made without departing from the spirit of the invention.

What I claim as new and desire to protect by Letters Patent is:

1. A clamp bar for drapery tables comprising:

a. an elongated body portion adapted to be moved slidably over the top surface of a drapery table, b. a series of clamps mounted in spaced relation along the length of said body portion, each operable to clamp an edge portion of a sheet of drapery fabric against said clamps, being selectively engaged or released by movement of an operating handle thereof in respectively opposite directions, c. a release lever extending substantially the full length of said body portion and pivoted thereto on an axis longitudinal to said body portion, said release lever having an inoperative position in which it does not engage said clamp handles, and being movable to an operative position, during which movement it engages and moves all of said clamp handles to release all of said clamps, and d. power means operable to move said release lever to said operative position.

2. A clamp bar as recited in claim 1 wherein said clamps may be mounted on said body portion at selectively different spacings along the length of said body portion, whereby the spacing between the operating handles of said clamps varies, said release lever being adapted by virtue of its continuity along the length of said body portion to engage and move said handles, when said lever is pivoted to its operative position, regardless of the spacing between said clamp operating handles.

3. A clamp bar as recited in claim 1 wherein said body portion and release lever both constitute extruded metal sections, the pivotal connection therebetween constituting interengaging hollow and solid cylindrical elements formed by extrusion respectively on said body portion and said release lever.

4. A clamp bar as recited in claim 1 with the addition of a cover sheet of pliable material covering the surfaces of said body portion engaging said drapery table and said drapery fabric, and releasable means for securing said cover sheet to said body portion.

5. A clamp bar as recited in claim 4 wherein said body portion constitutes an extruded metal section, the edges of said cover sheet extending longitudinally of said body portion being forced into frictional engagement with grooves formed by extrusion of said body portion.

6. A clamp bar as recited in claim 1 wherein said power means comprises:

a. a pneumatic ram mounted on said release lever and operable by extension thereof to pivot said lever to engage and move said clamp handles to release said clamps, and b. means operable to supply air under pressure to said ram.

7. A clamp bar as recited in claim 6 wherein said air supply means comprises:

a. a conduit for supplying air under pressure to said ram, from a pressure source, b. a valve interposed in said conduit, said valve having an inoperative position in which it seals off said pressure source and vents said ram to the atmosphere, and an operative position in which it seals off said vent and supplies pressure air to said ram, c. resilient means biasing said valve toward its inoperative position, and d. manual means for moving said valve to its operative position.

8. A clamp bar as recited in claim 6 including a series of said pneumatic rams carried by said release lever in longitudinally spaced relation therealong, said air supply means being operable to supply air under pressure simultaneously to all of said rams.

9. A clamp bar as recited in claim 1 wherein said release lever constitutes a planar flap normally extending horizontally from its pivotal axis, in which position it is supported by said body portion and to which position it is biased by gravity, and in which position it is disposed in spaced relation above a planar horizontal section of said body portion, and being operable by upward pivotal movement thereof to engage and move said clamp handles to release said clamps, and wherein said power means comprises:

a. a series of pneumatic cylinders mounted in the flap of said release lever in longitudinally spaced relation therealong, b. a piston operably mounted in each of said cylinders, c. a piston rod fixed to said piston and extending downwardly from said cylinder toward said planar horizontal surface of said body portion, d. a wheel carried rotatably at the extended end of said piston rod and engaging said planar horizontal surface of said body portion, the axis of said wheel being parallel to the pivotal axis of said release lever, e. a common conduit for supplying air from a pressure source to all of said cylinders, whereby said lever flap is pivoted upwardly, f. a valve disposed in said common conduit, said valve having an inoperative position in which said pressure source is sealed off and said cylinders are vented to the atmosphere, and an operative position in which said vent is sealed off and pressure air is supplied to said cylinders, g. resilient means biasing said valve toward its inoperative position, and h. manual means for moving said valve to its operative position.

* * * * *